US005628346A

United States Patent [19]

Corain et al.

[11] Patent Number: 5,628,346

[45] Date of Patent: May 13, 1997

[54] DEVICE FOR MEASURING THE WARP YARN TENSION IN A LOOM BY USE OF A DEVIATION BAR

[75] Inventors: Luciano Corain, Vicenza; Marco Novella, Valdagno; Roberto Spanevello, Schio, all of Italy

[73] Assignee: Nuovo Pignone S.p.A., Florence, Italy

[21] Appl. No.: 385,875

[22] Filed: Feb. 9, 1995

[30] Foreign Application Priority Data

Feb. 18, 1994 [IT] Italy ..... MI94A0287

[51] Int. Cl.[6] ..... D03D 49/18; D03D 49/04

[52] U.S. Cl. ..... 139/110; 73/159

[58] Field of Search ..... 139/110, 114, 139/103, 109; 73/159

[56] References Cited

U.S. PATENT DOCUMENTS

| | | | |
|---|---|---|---|
| 3,526,252 | 9/1970 | Hindle | 139/110 |
| 3,878,872 | 4/1975 | Hintsch | 139/110 |
| 3,952,779 | 4/1976 | Kodis . | |
| 4,572,243 | 2/1986 | Felix | 139/97 |
| 4,690,176 | 9/1987 | Thalmann et al. | 139/110 |
| 5,025,837 | 6/1991 | Gielen . | |
| 5,305,802 | 4/1994 | Fehrenbach | 139/110 |
| 5,355,912 | 10/1994 | Corain et al. . | |

FOREIGN PATENT DOCUMENTS

| | | |
|---|---|---|
| 0208366 | 1/1987 | European Pat. Off. . |
| 0590725 | 4/1994 | European Pat. Off. . |
| 2201361 | 4/1974 | France . |
| 2538902 | 7/1984 | France . |
| 1201764 | 8/1970 | United Kingdom . |
| 1201765 | 8/1970 | United Kingdom . |
| 1446573 | 8/1976 | United Kingdom . |
| WO93/25743 | 12/1993 | WIPO . |

*Primary Examiner*—Andy Falik

*Attorney, Agent, or Firm*—Oblon, Spivak, McClelland, Maier & Neustadt, P.C.

[57] ABSTRACT

A device for measuring the warp yarn tension of a woven fabric in a loom, which includes a fixed deviation bar which extends across the entire loom width and cooperates with a device measuring warp yarn tension, the fixed deviation bar having a central or intermediate portion for the fabric under formation, the intermediate portion being of a length less than that of a minimum formable fabric width and being detached from the remaining sections of the bar by thin breaks in the deviation bar. The intermediate portion is supported via at least one load cell. The device is located in the loom to measure the tension of the fabric already woven and prior to its being wound on the winding beam.

2 Claims, 2 Drawing Sheets

DEVICE FOR MEASURING THE WARP YARN TENSION IN A LOOM BY USE OF A DEVIATION BAR

BACKGROUND OF THE INVENTION

1. Field of the Invention

This invention relates to a new device for measuring the warp yarn tension of a woven fabric in a loom which, by using an interchangeable fixed structure acting on a limited central warp band of a width always less than the minimum width of the fabric to be formed and being hence independent of the width of said fabric, achieves effective, economical, reliable and in particular repeatable measurement of said tension, without the need for perfect positioning of said structure on the loom and hence of easy attainment. The term "repeatable measurement" is used in the sense that the measuring device continues to provide for the same fabric an identical tension value even on numerous different looms and independently of the width of the fabric under formation or of the length of the loom used, the invention concerning substantially an improvement to the measuring device described by U.S. Pat. No. 5,355,912 by the present applicant.

2. Discussion of the Background

As is well known, in a loom the warp yarn tension must be always maintained constant and hence be constantly measured and continuously adjusted, otherwise it could vary as the delivery of said yarn by the beam proceeds, because the radius of the yarn wound on the beam decreases whereas the angular velocity of the latter remains constant, the tangential delivery speed of the warp yarn hence decreasing, with consequent increase in the yarn tension.

U.S. Pat. No. 5,355,912 application it is not the warp yarn tension which is measured but instead the tension of the fabric under formation, this however being practically the same as that of the warp yarns given what said yarns are directly connected to the fabric, said tension being determined indirectly by measuring the elastic deformation which it generates on the fixed deviation bar for the fabric under formation. In other words, the measuring device of said U.S. Pat. No. 5,355,912 consists substantially of a deformation sensor which is fixed onto the fixed fabric deviation bar supported by the fixed loom frame only at its ends, to measure an elastic deformation value caused by the warp yarn tension over the entire length of the bar, this value being compared in a comparator with a set value to control the geared motor of said beam.

Such a known device, besides involving considerable constructional difficulty in fixing a sensor to a bar which generally has a minimum length of the order of 2 meters, with consequent cost increase, has in particular the drawback of providing a warp yarn tension value which is influenced by the constraints to which the fixed deviation bar for the fabric under formation is subjected, and hence not allowing precise determination of the tension to which each individual warp yarn is subjected.

SUMMARY OF THE INVENTION

The object of the present invention is to obviate said drawbacks by providing a device for measuring the warp yarn tension of a woven fabric in a loom which is constructionally simple, does not require high accuracy in its positioning and in particular is not influenced by constraints of any kind and which, by providing a repeatable measurement, can be used on all types of loom.

This is substantially attained in that the entire length of the fabric fixed deviation bar is no longer used but instead only a limited intermediate portion of said bar, free from constraints and of length less than the minimum width of the formable fabric, this portion, detached from the two remaining bar sections, being supported by the fixed frame of the loom via a load cell.

In this manner the measurement is no longer influenced by the length and constraints of the bar nor by the width of the fabric under formation (i.e. woven fabric), given that only a constant narrow band of fabric is used for the measurement.

Again, said fixed structure, acting substantially as an electronic balance on a limited intermediate fabric band, not only does not require very precise positioning with respect to the other two sections because it is in any event loaded by said fabric band, but in particular allows effective and reliable determination of the tension to which each individual warp yarn is subjected by simply knowing the density of the warp yarns of the fabric under formation.

Hence, the device for measuring the warp yarn tension of a woven fabric in a loom comprising a warp yarn feed beam, a geared electric motor for operating said beam, for the fabric under formation a fixed deviation bar which extends across the whole loom width supported by the loom fixed frame and cooperates with the device for measuring the warp yarn tension, and a comparator electrically connected to said measuring device and to an adjustable set-value unit the output of which controls said beam geared motor, is characterized according to the present invention by consisting of an interchangeable fixed structure formed from at least one limited intermediate portion of said fixed deviation bar for the fabric under formation, of a length less than the minimum formable fabric width, said portion, detached from the remaining sections of the bar, being supported by said loom fixed frame via at least one load cell.

Again, to prevent the fabric under formation from sinking into the breaks between said bar intermediate portion and said bar sections, according to a preferred embodiment of the present invention said breaks between said bar intermediate portion and said bar sections are formed as a thin slice, i.e. along a direction inclined to the longitudinal axis of the bar and contained in a horizontal plane.

BRIEF DESCRIPTION OF THE DRAWINGS

The invention is described in detail hereinafter with reference to the accompanying drawing which illustrates a preferred embodiment thereof given by way of non-limiting example only, in that technical or constructional modifications can be made thereto but without departing the scope of the present invention.

DESCRIPTION OF THE PREFERRED EMBODIMENTS

Figure 1:
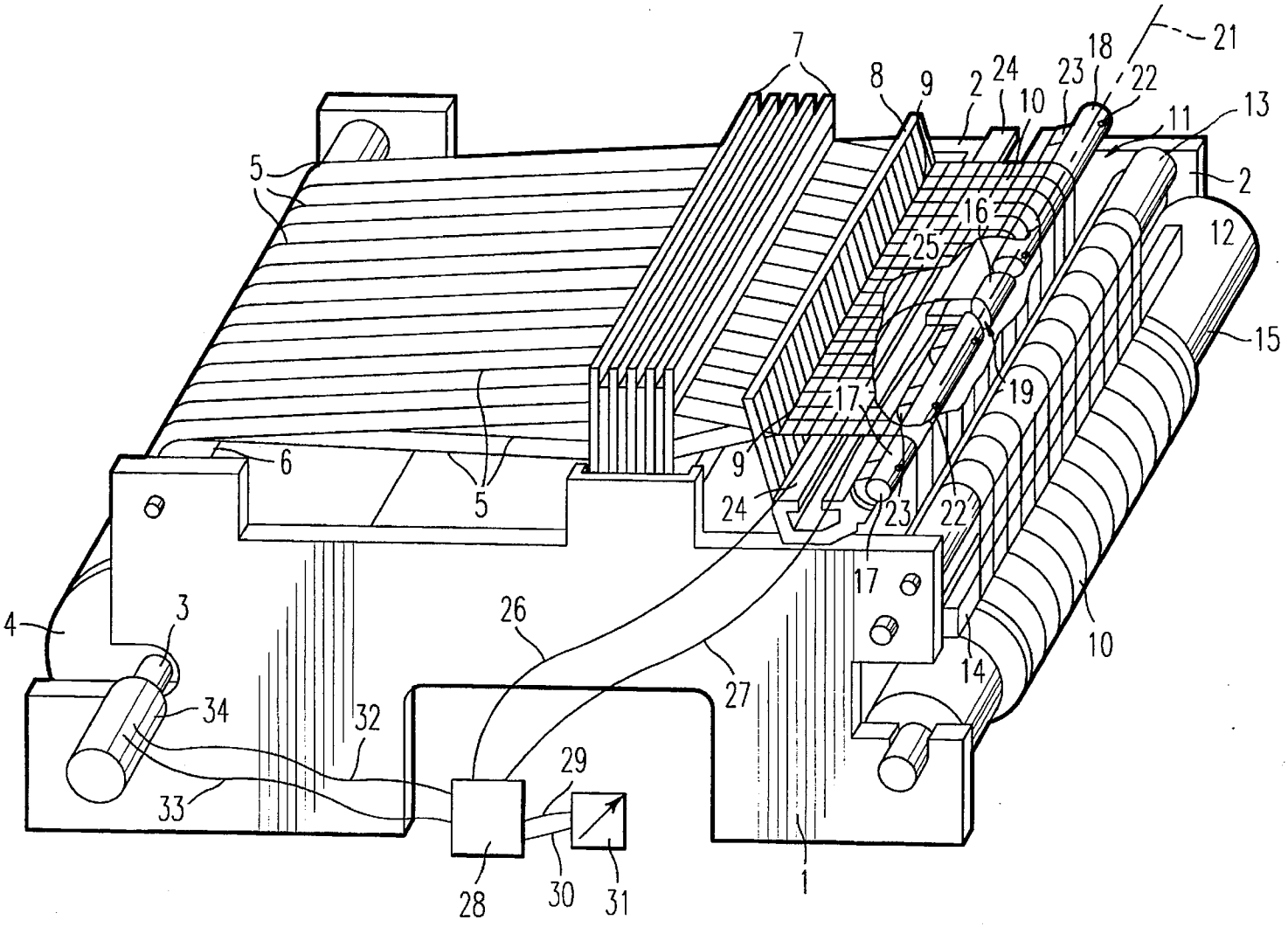
In FIG. 1 is represented a partly sectional partial perspective view of a loom using the warp yarn tension measuring device in accordance with the invention.
Figure 2:
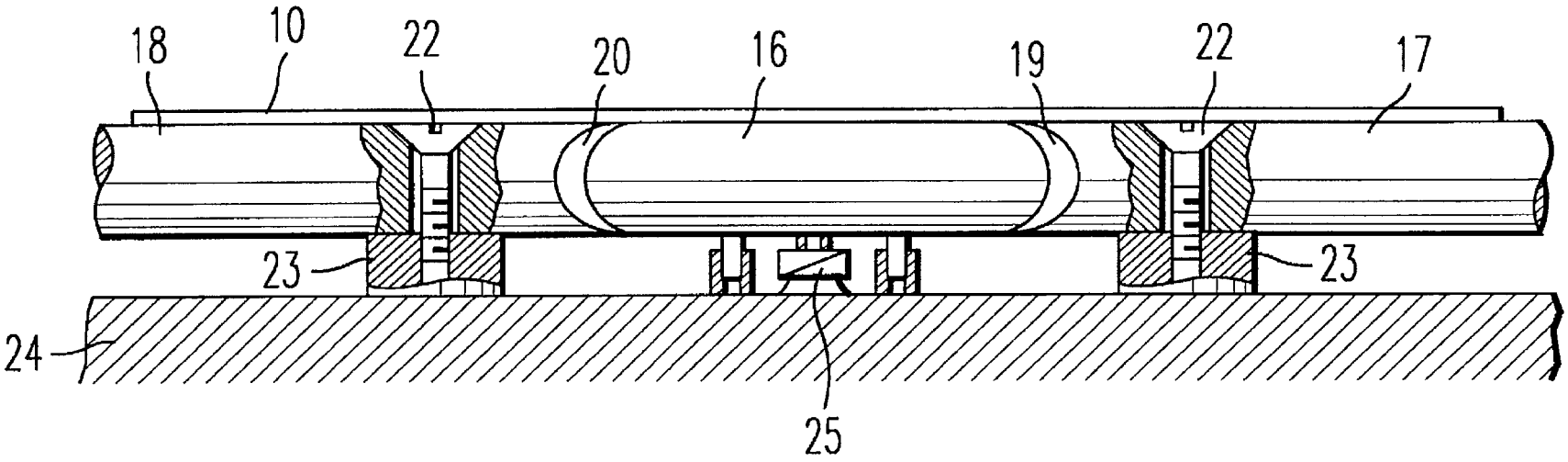
FIG. 2 is a view showing how the intermediate portion of the deviation bar is fixed to the support beam.

In FIGS. 1 and 2 reference numerals 1 and 2 indicate the two fixed loom shoulders supporting the shaft 3 of the beam 4 which feeds the warp yarns 5. Said warp yarns 5 pass about the yarn holder 6, pass through the eyelets of the heddle frames 7 and through the teeth of the reed 8 to form the edge 9 of the forming fabric 10 which is deviated by the fixed deviation bar 11 to pass about the take-up roller 12, about the reversal roller 13 and about the diverting bar 14 to wind onto the winding beam 15 rotatably supported by said shoulders 1 and 2.

Said fixed deviation bar 11, which extends across the entire loom width, consists substantially of an intermediate bar portion 16 located in a central portion of bar 11 and two lateral bar sections 17 and 18 separated from said portion 16 by breaks 19 and 20 which, as clearly visible on the drawing, are of a thinly sliced form, ie extending along a direction which in a horizontal plane is inclined to the longitudinal axis 21 of the bar 11, so that no warp yarn of the woven fabric can penetrate into said breaks.

Said two bar sections 17 and 18 are fixed by bolts 22, via spacers 23 onto a support beam 24 which is supported by said shoulders 1 and 2 to form the fixed loom frame. Said intermediate bar portion 16, which has a length just less than the minimum width of fabric which can be woven or formed so as to ensure that the entire length of the portion 16, is always subjected to the tension of the fabric under formation 10, thus making the measurement repeatable. The intermediate bar portion 16 is also fixed to said support beam 24 but by way of a load cell 25 which is electrically connected by cables 26 and 27 to one input of a comparator 28, the other input of which is connected by electric cables 29 and 30 to an adjustable set-value unit 31. The output of said comparator 28 is connected by the electric cables 32 and 33 to the geared electric motor 34 operating said beam 4. Hence, the intermediate bar portion 16 and load cell 25 form a fixed measuring structure which is interchangeable.

The method of operation is as follows.

Whenever the tension in the warp yarns 5 and hence in the fabric under formation 10 varies for any reason, the increase or decrease in the pressure on the load cell 25 exerted by the intermediate bar portion 16 causes said interchangeable measuring structure 16, 25 to provide an electrical signal different from the set value provided by the unit 34, so that the comparator 28 provides an error signal which by varying the velocity of the beam 4 varies the tension in the warp yarn to return it to the required value, said adjustment being always valid even if the width of the fabric to be formed varies and/or if the loom is changed.

We claim:

1. A device for measuring the warp yarn tension in a loom by measuring tension of a woven fabric before being wound up on a winding beam, which comprises:

a warp yarn feed beam, an electric motor operating said beam, a single fixed deviation bar for the fabric, said deviation bar being adapted to extend across a width of the loom, a device associated with said deviation bar, said device measuring said tension of said woven fabric wherein said device measures tension as a function of said warp yarn tension which is due to a difference between a collection speed of said winding beam and a releasing speed of the warp yarn feed beam, a fixed frame which supports and cooperates with said device;

an adjustable set valve unit, a comparator electrically connected to said measuring device and to said adjustable set-value unit wherein an output signal of said comparator controls said motor based on signals received from said measuring device by said comparator, said fixed deviation bar having an interchangeable fixed structure located at at least an intermediate portion of said fixed deviation bar, said intermediate portion being of a length less than a minimum formable fabric width and said portion being separated from the remaining sections of the bar and said fixed frame supporting said intermediate portion.

2. An apparatus measuring the warp yarn tension of a woven fabric in a loom, which comprises:

a warp yarn feed beam, a geared electric motor operating said beam, a fixed deviation bar for a fabric under formation, said deviation bar being adapted to extend across a width of the loom, a tension measuring device, a fixed frame which supports and cooperates with said device, an adjustable set-valve unit;

a comparator electrically connected to said measuring device and to said adjustable set-value unit wherein an output signal of said comparator controls said motor based on signals received from said measuring device by said comparator, said fixed deviation bar having an interchangeable fixed structure located at at least an intermediate portion of said fixed deviation bar, said intermediate portion being of a length less than a minimum formable fabric width and said portion being separated from remaining sections of the bar, and said fixed frame supporting said intermediate portion wherein said intermediate portion of said bar and said remaining bar sections have breaks located therebetween in a direction inclined with respect to the longitudinal axis of the bar and located in a horizontal plane thereof.

* * * * *